US008662646B2

(12) United States Patent
Morgan et al.

(10) Patent No.: US 8,662,646 B2
(45) Date of Patent: Mar. 4, 2014

(54) DROPLET GENERATOR

(75) Inventors: Jonathan Morgan, Cambridgeshire (GB); Jonathan Harvey Lucas, Essex (GB)

(73) Assignee: Domino Printing Services PLC, Bar Hill, Cambridge, Cambridgeshire (GB)

( * ) Notice: Subject to any disclaimer, the term of this patent is extended or adjusted under 35 U.S.C. 154(b) by 1667 days.

(21) Appl. No.: 11/660,651

(22) PCT Filed: Sep. 14, 2005

(86) PCT No.: PCT/EP2005/054577
§ 371 (c)(1), (2), (4) Date: Mar. 20, 2007

(87) PCT Pub. No.: WO2006/030018
PCT Pub. Date: Mar. 23, 2006

(65) Prior Publication Data
US 2007/0257970 A1 Nov. 8, 2007

(30) Foreign Application Priority Data
Sep. 15, 2004 (EP) ..... 04255578

(51) Int. Cl.
*B41J 2/02* (2006.01)

(52) U.S. Cl.
USPC ..... 347/75; 347/81

(58) Field of Classification Search
USPC ..... 347/74–81
See application file for complete search history.

(56) References Cited

U.S. PATENT DOCUMENTS

| | | | | |
|---|---|---|---|---|
| 3,972,474 | A | 8/1976 | Keur | |
| 4,068,144 | A | 1/1978 | Toy et al. | |
| 4,095,232 | A | 6/1978 | Cha et al. | |
| 4,417,255 | A | 11/1983 | Furukawa et al. | |
| 5,598,197 | A | 1/1997 | Zaba | |
| 6,655,769 | B2 * | 12/2003 | Sawano | 347/5 |
| 6,655,796 | B2 | 12/2003 | Sharma | |
| 2005/0253905 | A1 * | 11/2005 | Orme-Marmerelis et al. | 347/75 |

FOREIGN PATENT DOCUMENTS

| | | |
|---|---|---|
| EP | 0 482 123 | 4/1992 |
| EP | 1277941 | 1/2003 |
| JP | 54-054033 | 6/1976 |
| JP | 51-068113 | 4/1979 |
| JP | S54-54003 | 4/1979 |
| JP | 55 030939 | 5/1980 |
| JP | 56 104065 | 8/1981 |
| JP | 63 25050 | 2/1982 |
| JP | 58 096565 | 8/1983 |
| JP | S61-175046 | 8/1986 |
| JP | 61175451 | 11/1986 |

(Continued)

OTHER PUBLICATIONS

Communication in Corresponding EP App. No. 09 00 7289.

(Continued)

*Primary Examiner* — Kevin S Wood

(57) ABSTRACT

The present invention provides a droplet generator (10) of the velocity modulation type, the generator (10) being configured so that substantially all the modulation energy generated by piezo-electric crystals (60) is transformed into vibration of the nozzle (34). The generator preferably also includes an internal closure mechanism (70) which blocks off the nozzle (34) when the generator is not in operation, but which is de-coupled from the modulation process when the generator is operating.

11 Claims, 2 Drawing Sheets

(56) References Cited

FOREIGN PATENT DOCUMENTS

| | | |
|---|---|---|
| JP | 63 027265 | 2/1988 |
| JP | 61-169571 | 4/1988 |
| JP | 61-175046 | 8/1988 |
| JP | 2004 142382 | 2/2004 |
| WO | WO 91/00808 | 1/1991 |

OTHER PUBLICATIONS

Communication in Corresponding China App. No. 200580031119.4 (PCT/EP2005/054577).
Communication in Corresponding EP App. No. 05 789 444.6-1251.
Indian Search Report Apr. 21, 2011.
Japan Office Action, Feb. 24, 2009.

* cited by examiner

DROPLET GENERATOR

FIELD OF THE INVENTION

This invention relates to a droplet generator and, in particular, to a droplet generator for a continuous inkjet printer.

BACKGROUND TO THE INVENTION

The core of a continuous inkjet printer is a droplet generator. This component generates a stream of droplets from a body of ink.

The design of a droplet generator has a known theoretical basis, allied to which there are a number of practical limitations.

The mathematics of dividing an ink stream into droplets has been described by Rayleigh. The underlying mechanism of forming the stream into droplets, a process known as modulation, involves creating instability in the ink steam. Factors which influence instability include ink surface tension, ink density, nozzle diameter, and the wavelength of the vibration used to create the instability, along the jet.

It thus follows that different inks may require a different droplet generator.

Two primary methods of modulation are encountered in continuous inkjet printers. In the first, the ink is directly vibrated within a chamber before being discharged through a nozzle. This is known as pressure modulation. In the second, the nozzle is vibrated with respect to a body of ink in contact with the nozzle. This is known as velocity modulation. In reality, a modulation system may include elements of both pressure modulation and velocity modulation.

Historical experience indicates that a typical droplet generator must produce ink droplets whilst operating in a frequency range of 40-130 kHz. It is also well known that there is a practical upper limit for the speed at which the stream of ink droplets impacts the substrate being printed. In essence, there is a well-understood relationship between frequency, nozzle size and print quality.

In the past, droplet generators have employed acoustic energy derived from piezo electric crystals to generate the instability required to produce the droplets. Typically these generators have been designed and constructed as resonant systems to minimise power requirements and energy loss. However, problems invariably arise with mass-produced resonant systems as variations in the tolerances inherent in any manufacturing process, lead to variations in system resonance. As a consequence of the variations in resonance, existing drop generators typically display a lack of consistency in performance is between units. One method of tuning to compensate for this variability is to change a component of the system, such as the nozzle, until the required performance is achieved. This method is inefficient in that it requires the intervention of a skilled technician. For example, we find that tuning by changing nozzles typically involves discarding a number of nozzles for each printer.

Efforts have been made, in the past, to address the problems inherent in resonant systems. European Patent 0 252 593 describes a droplet generator specifically designed to be non-resonant. This is achieved by forming the components of the droplet generator from acoustically soft materials such as poly(phenylene sulphide). Whilst forming a droplet generator from acoustically soft materials may eliminate resonances, experimental work which we have undertaken suggests that modulation (the control of the droplet generation process) is poor with acoustically soft materials. Further, the efficient use of such materials on a mass-production basis would involve significant tooling costs.

A further example of a non-resonant system is described in U.S. Pat. No. 3,972,474. However, during operation of the droplet generator described in this patent, significant acoustic energy is applied to the column of ink within the generator, and thus the design of the device has to take into account the fundamental resonance frequency of the ink column and hence the speed of sound of the ink. This renders the device sensitive to ink type and means that tuning is inevitably required.

It is an object of this invention to provide a droplet generator, particularly a droplet generator for a continuous inkjet printer, which goes at least some way to addressing the problems described above; or which will at least provide a novel and useful alternative.

SUMMARY OF THE INVENTION

Accordingly, in one aspect, the invention provides a droplet generator having an operating frequency and a resonant frequency substantially greater than said operating frequency, said droplet generator including:

a fluid chamber;

a nozzle defining an outlet from said fluid chamber;

an actuator to vibrate said nozzle with respect to said fluid chamber at an operating frequency such that, in use, a stream of fluid emitted through said nozzle, along an ejection axis, is broken into droplets;

said droplet generator being characterised in that said fluid chamber is defined within a substantially rigid, substantially immoveable body; and the output of said actuator is applied to vibrating said nozzle with respect to said body substantially along said ejection axis.

Preferably the mass of said body is substantially greater than the mass of said nozzle.

Preferably said body is defined by a main body and a nozzle body, said nozzle being included in or on said nozzle body and said fluid chamber being defined within the combination of said main body and said nozzle body.

Preferably that part of said fluid chamber defined in said main body is substantially cylindrical with respect to said ejection axis.

Preferably said actuator comprises one or more piezo electric crystals located between said nozzle body and said main body.

Preferably said nozzle is defined by a jewel fixed to said nozzle body.

Preferably said drop generator further includes closure means passing through said fluid chamber and engageable against said nozzle such that, when said actuator is not operating, said closure means prevents fluid passage through said nozzle and wherein, when said actuator is operating, said closure means is held substantially static with respect to said body.

Preferably said closure means is displaceable substantially along said ejection axis.

Preferably said closure means includes a rod mounted substantially along said ejection axis.

In a second aspect the invention provides a droplet generator including:

a fluid chamber;

a nozzle defining an outlet from said fluid chamber;

an actuator operable to vibrate said nozzle with respect to said fluid chamber such that, in use, a stream of fluid emitted through said nozzle, along an ejection axis, is broken into droplets; and closure means passing through said fluid chamber and engageable against said nozzle such that, when said actuator is not operating, said closure means prevents fluid passage through said nozzle and wherein, when said actuator is operating, said closure means is restrained against movement.

Preferably said nozzle is constrained for displacement with respect to said fluid chamber along said ejection axis, said closure means being displaceable along, said axis between a closed position in which said closure means contacts said nozzle, and an open position in which fluid may pass through said nozzle.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future. The scope of the invention should be interpreted by the appended claims alone.

BRIEF DESCRIPTION OF THE DRAWINGS

The various aspects of the invention will now be described with reference to the accompanying drawings in which.

DETAILED DESCRIPTION OF WORKING EMBODIMENT

Figure 1:
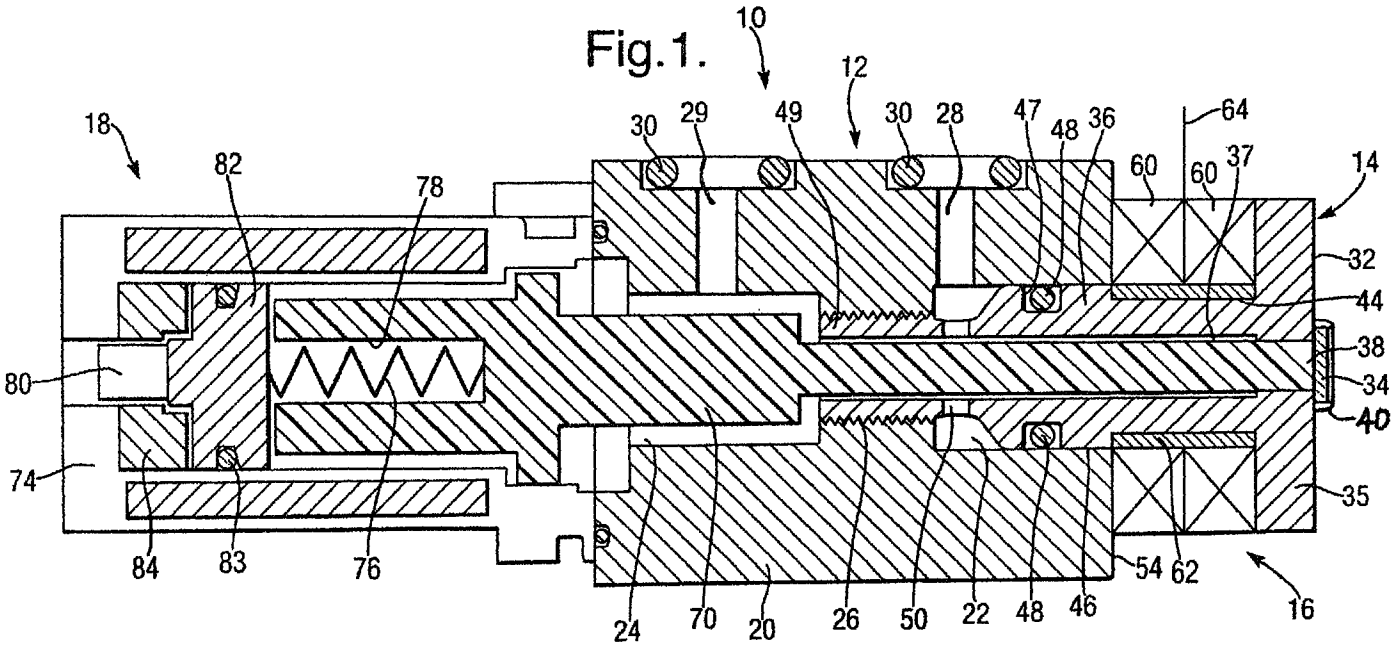
FIG. 1: shows a cross-section through a droplet generator according to the invention.

Referring firstly to FIG. 1, the invention provides a droplet generator 10 having four principal elements. These elements comprise a main body 12, a nozzle assembly 14, an actuator assembly 16 to vibrate the nozzle included within the nozzle assembly, and a stop/start mechanism 18.

As is well known in the field of the invention, the droplet generator has an operating frequency and a resonant frequency. In the past, considerable effort has been applied to ensuring, the resonant frequency is at or very close to the required operating frequency. One characterising feature of this invention is that the droplet generator is designed and constructed so as to ensure that the resonant and operating frequencies differ considerably.

In the form shown the main body comprises a block 20 of substantial material such as, for example, stainless steel. A suitable grade of stainless steel is 316 which has a density of about 8000 kg/m$^3$.

Formed in the block 20 is a cylindrical front chamber 22, a cylindrical rear chamber 24, and a retaining section 26 intermediate the chambers 22 and 24. Ports 28 and 29 are formed through the block 20 and communicate with the chambers 22 and 24 respectively. In use, flushing fluid is passed into the chamber 22 via port 28 whilst ink is passed into chamber 24 via port 29.

Ink and flushing fluid may be supplied to the ports 29 and 28 from a manifold assembly (not shown) which is fixed to the outer surface of the block 20. Annular O-ring seals 30 are typically provided to prevent leakage of the fluids between the manifold and the block 20.

The nozzle assembly 14 is in fluid communication with the main body 20 and, in the particular form shown in the drawings, the assembly 14 comprises a nozzle body 32 and a nozzle member 34 attached to the nozzle body 32. The nozzle body, which is also conveniently formed from 316 grade stainless steel, has a front flange 35, a rearwardly extending stem 36 which is partly received within the block 20, and a through-bore 37 which extends axially through the stem 36 and exits at 38 through the front flange 35. A suitable mount 40 is provided on the front flange 35 to mount the nozzle member 34 in a position so that it overlies exit 38 of the through-bore 37. Conveniently the amount 40 comprises a collar 41 (or parts of a collar) which may be crimped over the edges of the nozzle member 34 to retain the same in position. Alternatively, other methods of fixing the nozzle member 34 to the front flange 35 could be employed including (but not limited to) adhesive bonding. The mounting is such as to allow a small amount of axial movement (in the order of a micron or so) of the jewel under the influence of the actuator assembly 16.

The first outer section of the stein 36, as the stem extends rearwardly from the front flange 35, comprises a plain cylindrical surface 44, the purpose of which will be described in greater detail below. The cylindrical surface 44 transforms, at its rear edge, into collar 46, the collar 46 being a sliding fit within front chamber 22 in the main body. As can be seen, a peripheral groove 47 is provided around the collar 46 into which an O-ring seal 48 may be fitted to prevent fluid in the chamber 22 escaping about the outer surface of the stem 36. Finally, the outer rear surface 49 of the stein 36 is sized and shaped to co-operate with intermediate section 26 in the main body 20 to retain the nozzle body within the main body. As shown, this is achieved by forming the intermediate section 26 of the main body and outer rear surface 49 of the nozzle body with co-operating screw threading. Although other means of retaining the nozzle body within the main body could be employed, screw threading has additional advantages which will become apparent from the description which follows.

It will also be noted that the stem 36, where it passes through front chamber 22 in the main body 20, includes one or more radial ports 50 which place the through-bore 37 in communication with the chamber 22.

The nozzle member 34 is preferably defined by a jewel having an emission aperture of the desired dimension formed there-through. It is well known in the art to employ drilled sapphire jewels. Alternative nozzle members include foils which may be crimped or bonded to the front face of flange 35 so as to overlie exit 38 of the through-bore.

In order to achieve droplet generation, the nozzle member is vibrated with respect to the ink source at a predetermined frequency. In the embodiment of droplet generator described herein, this is achieved by applying a vibrating action between parallel surface parts of the main body 20 and the nozzle body 32. In the form shown, the vibrating action is generated between front face 54 of the main body 20, and the rear surface of front flange 35 of the nozzle body 32. However, because the components 20 and 32 are formed of substantially rigid material, the vibration is transmitted through the nozzle body to the nozzle member 34.

In the conventional manner, the source of vibration is one or more, in this case two, piezo-electric crystal actuators 60. These are mounted on an insulating sleeve 62 which in turn, is fitted over the plain cylindrical surface 44 formed on the nozzle body stem 36. The screw thread arrangement between the nozzle body and the main body allows easy assembly of the various components and also ensures an axial clamping force is maintained on the piezo-electric crystals 60.

The crystals 60 are driven from suitable driving circuitry (not shown) which does not form part of the invention. A positive drive terminal 64 is shown sandwiched between the crystals. The other side of each crystal is earthed through the main body 20 being earthed.

The preferred or required mode of vibration is one in which the nozzle member 34 is vibrated substantially along the axis of the stem 36 and the chamber 22. However other modes are possible and these other modes are reduced (if not practically eliminated) by constraining the cylindrical surface 44 from deformation other than along its axis. The stronger the insulating sleeve 62, the less other modes of vibration detract from the drop generating performance.

Figure 2:
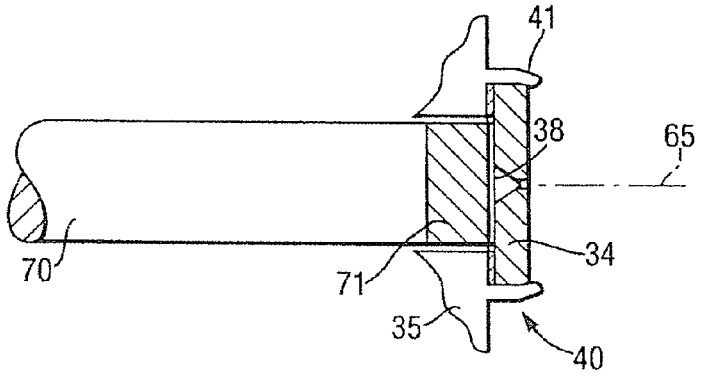
FIG. 2: shows an enlarged view of a nozzle member included in the droplet generator shown in FIG. 1.

In use, ink fed through port 29 passes, via through, through-bore 37 to the rear surface of the nozzle member. Actuation of the crystals 60 then vibrates the nozzle member 34 substantially along ejection axis 65 (FIG. 2), causing the ink to flow through the nozzle aperture and break into droplets.

A further important aspect of a droplet generator according to the invention is the incorporation of start/stop mechanism 18. The rationale for the inclusion of such a mechanism is as described in our European Patent No. 0 482 123. However, the implementation of such a facility in this velocity-modulation application (in which the nozzle member displaces) has presented significant problems, not least of which being that the main component of the start/stop mechanism has a natural resonance within the operating frequency range of the generator. Accordingly, unless carefully controlled, the start/stop mechanism will interfere with modulation.

As shown, the main start/stop element comprises closure means in the form of a plunger 70 which is mounted substantially on the axis of the chambers 22 and 44, and thus the ejection axis 65. The plunger is also substantially co-axial with the stem 36 of the nozzle body and with the nozzle member itself. Indeed, as can be seen in FIG. 1, the plunger passes centrally through through-bore 37. The plunger 70 includes an elastomeric seal 71 at its free end, which seal contacts the rear surface of the nozzle member 34 to prevent the unintentional passage of ink through the nozzle member.

The plunger 70 is displaced into and out of a closed position, in contact with the nozzle member, by means of a solenoid 74 which overlies rear chamber 24 of the main body 20. A spring 76 is provided to bias the plunger against the nozzle member 34.

In the particular form shown, the spring 76 is seated in an axial bore 78 provided in the rear end of the plunger 70. An adjustment mechanism is provided which includes a set-screw 80, and a backstop 82 in contact with, and displaceable by, the set-screw. The backstop includes an annular seal 83 to prevent ink escaping rearwardly from the chamber 24. In use, the set-screw 80 is rotated in its mounting boss 84 to position the backstop 82 and thus limit the movement of the plunger 70 under the influence of solenoid 74. This, then, establishes the operating clearance between the plunger and the nozzle member 34. Typically the operating clearance is set to around 200 microns which is too small to allow fluid (ink) resonance to affect the operating characteristics of the device.

To minimise the influence of the start/stop mechanism on the modulation characteristics of the system, the start/stop mechanism, when the droplet generator is operating, is effectively isolated or decoupled from the modulation process. This is in contrast to the arrangement described in European Patent 0 482 123 and, in the form shown herein, is achieved by substantially locking the plunger 70 with respect to the main body 20. To this end, when the solenoid 74 is energised and the plunger 70 is withdrawn into an open position, the plunger is held firmly in contact against the backstop 82. In this way, the plunger is effectively locked in position and has substantially no influence on the modulation process.

The operating system is such that the solenoid 74 is energised and the plunger 70 withdrawn and locked in the open position just prior to an operating voltage being applied to crystals 60. Thus the plunger cannot reciprocate along its axis and influence modulation.

In use, with the droplet generator clamped solidly to the printhead assembly of a continuous inkjet printer an oscillating drive current applied to crystals 60 produces a vibration which, because the mass of nozzle 34 is considerably less than the mass of the main body 20, and because the generator itself cannot move, is substantially fully converted into vibration of the nozzle member.

Whilst experimentation has been undertaken with main bodies formed from poly(etheretherketone) (PEEK), the structurally stiffer nature of stainless steel means that, for a given size, unwanted modes of vibration of the nozzle member are better suppressed.

A droplet generator as described herein is found to lave a resonant frequency of the order of 200 kHz. This is to be contrasted with typical operating frequencies in the range 64-128 kHz though the device as herein described has shown satisfactory results, during testing, operating at frequencies in the range of 50-150 kHz. It will thus be appreciated that the one droplet generator can be easily tuned to operate with inks of different viscosities and at different temperatures.

Figure 3:
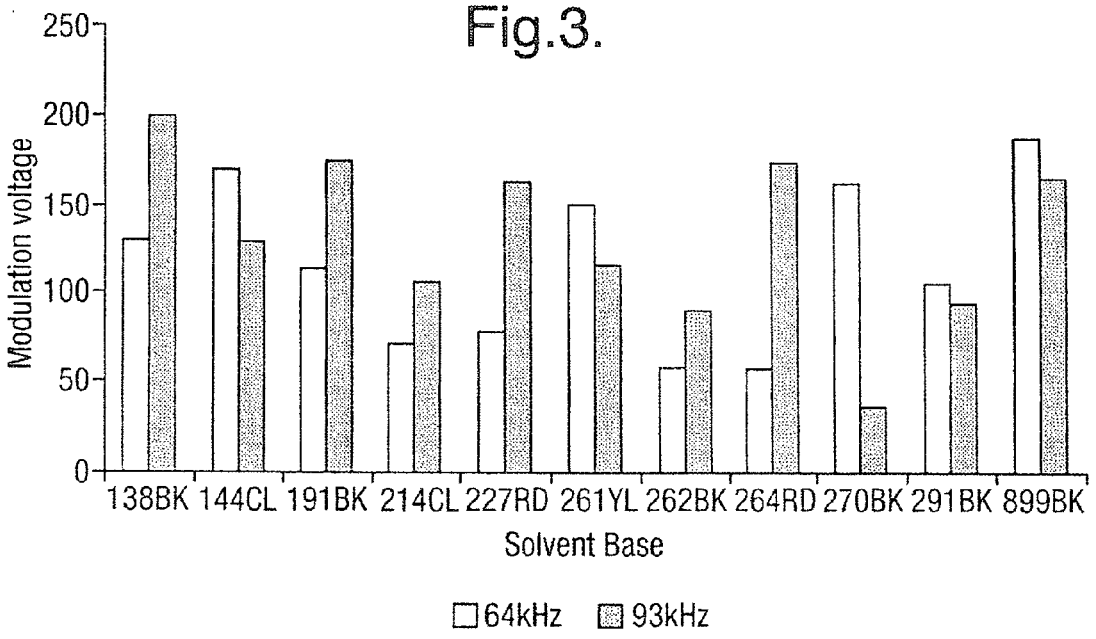
FIG. 3: shows the modulation behaviour of a droplet generator according to the invention using a variety of different fluids.

A further characteristic of the droplet generator as described is that because substantially the entire acoustic energy is applied to the vibration of the nozzle member 34, substantially no acoustic energy is applied to the inks and, as a consequence, ink resonance(s) can be ignored. Differences in modulation are solely dependent on the interaction between the ink and the nozzle Turning now to FIG. 3, a plot is shown indicating the modulation voltage required to achieve the onset of modulation for eleven different inks. As can be seen, modulation can be achieved for all the tested inks well within the normal operating voltage window for devices of this type, without any additional tuning being required. This is in contrast to the pressure modulated droplet generator currently used on our A-series printer which typically requires a change of drive rod to function with different inks.

The invention claimed is:

1. A droplet generator having an operating frequency and a resonant frequency substantially greater than said operating frequency, said droplet generator including:

a fluid chamber;

a nozzle defining an outlet from said fluid chamber;

an actuator to vibrate said nozzle with respect to said fluid chamber at an operating frequency such that, in use, the vibrating nozzle produces a stream of fluid emitted through said nozzle, along an ejection axis, broken into droplets;

said droplet generator being characterized in that said fluid chamber is defined within a substantially rigid, substantially immoveable body; and the output of said actuator is applied to vibrating said nozzle with respect to said body substantially along said ejection axis.

2. A drop generator as claimed in claim 1 wherein the mass of said body is substantially greater than the mass of said nozzle.

3. A drop generator as claimed in claim 1 wherein said body is defined by a main body and a nozzle body, said nozzle being included in or on said nozzle body and said fluid chamber being defined within the combination of said main body and said nozzle body.

4. A drop generator as claimed in claim 3 wherein that part of said fluid chamber defined in said main body is substantially cylindrical with respect to said ejection axis.

5. A drop generator (10) as claimed in claim 1 wherein said actuator comprises one or more piezo electric crystals located between said nozzle body and said main body.

6. A drop generator as claimed in claim 1 wherein said nozzle is defined by a jewel fixed to said nozzle body.

7. A drop generator as claimed in claim 1 further including closure means passing through said fluid chamber and engageable against said nozzle such that, when said actuator is not operating, said closure means prevents fluid passage through said nozzle and wherein, when said actuator is operating, said closure means is held substantially static with respect to said body.

8. A drop generator as claimed in claim 7 wherein said closure means is displaceable substantially along said ejection axis.

9. A drop generator as claimed in claim 7 wherein said closure means includes a rod mounted substantially along said ejection axis.

10. A drop generator as claimed in claim 1 wherein said nozzle is constrained for displacement with respect to said fluid chamber along said ejection axis, said closure means being displaceable along said axis between a closed position in which said closure means contacts said nozzle, and an open position in which fluid may pass through said nozzle.

11. A droplet generator according to claim 1, wherein the frequency of the nozzle has a resonance of about 200 kHz producing acoustic energy, and substantially all of the acoustic energy produced therein applied to inks.

* * * * *